US007930768B1

(12) United States Patent
Tyler

(10) Patent No.: US 7,930,768 B1
(45) Date of Patent: Apr. 26, 2011

(54) BANDANA HAT SYSTEM

(76) Inventor: Larry L. Tyler, Palm Harbor, FL (US)

( * ) Notice: Subject to any disclaimer, the term of this patent is extended or adjusted under 35 U.S.C. 154(b) by 180 days.

(21) Appl. No.: 12/319,756

(22) Filed: Jan. 12, 2009

(51) Int. Cl.
*A41B 1/00* (2006.01)
*A41B 1/06* (2006.01)
*A41B 5/00* (2006.01)

(52) U.S. Cl. ..... 2/209.11; 2/183; 2/209.12; 2/202; 2/205; 2/195.4; 2/173

(58) Field of Classification Search ..... 2/410, 4, 2/6.2, 8.2, 417–420, 422, 425, 15, 10, 468, 2/63, 88, 91, 171, 171.02, 171.04, 171.1, 2/171.2, 171.3, 171.4, 171.5, 171.6, 171.7, 2/171.8, 172, 181, 181.4, 183, 184.5, 195.2, 2/175.6, 209.11, 209.12, 209.13, 208, 207, 2/206, 204, 202
See application file for complete search history.

(56) References Cited

U.S. PATENT DOCUMENTS 1,234,828 A * 7/1917 Tramana ..... 2/171.01
2,472,033 A * 5/1949 Wetzel ..... 2/4
2,615,168 A * 10/1952 Springer et al. ..... 2/195.2
2,704,366 A * 3/1955 Arnold ..... 2/171.01
4,023,212 A * 5/1977 Huffman ..... 2/195.2
4,180,868 A * 1/1980 Snow ..... 2/203
4,980,928 A * 1/1991 Ellis ..... 2/88
5,048,128 A * 9/1991 Watson, Jr. ..... 2/204
5,062,157 A * 11/1991 Muta ..... 2/171
5,062,163 A * 11/1991 Avey ..... 2/424
5,083,317 A * 1/1992 DeMoreta ..... 2/174
5,091,993 A * 3/1992 Merrill et al. ..... 2/4
5,099,524 A * 3/1992 Linday ..... 2/181
5,121,507 A * 6/1992 Brown ..... 2/172
5,153,943 A * 10/1992 Clement ..... 2/418
5,201,077 A * 4/1993 Dondlinger ..... 2/209.3
5,355,535 A * 10/1994 Bruder ..... 2/172
5,406,645 A * 4/1995 Lin ..... 2/10
5,493,734 A * 2/1996 Nieves-Rivera ..... 2/209.13
5,517,691 A * 5/1996 Blake ..... 2/5
5,542,127 A * 8/1996 Bezanis ..... 2/172
5,548,846 A * 8/1996 Bianchetti ..... 2/209.12
D373,894 S * 9/1996 Turner ..... D2/881
5,570,476 A * 11/1996 Olive ..... 2/200.1
D381,191 S * 7/1997 Monkhouse et al. ..... D2/891
5,664,261 A * 9/1997 Lacy ..... 2/172
5,669,075 A * 9/1997 Weeks ..... 2/172
5,701,609 A * 12/1997 Bridges ..... 2/422
5,713,076 A * 2/1998 Davis ..... 2/4
5,724,676 A * 3/1998 Amendolia et al. ..... 2/195.2
5,887,287 A * 3/1999 Potochnik ..... 2/209.13
5,901,380 A * 5/1999 Mishal ..... 2/172
5,924,129 A * 7/1999 Gill ..... 2/10
D420,493 S * 2/2000 Blake ..... D2/866
D421,675 S * 3/2000 Phillips ..... D2/891
6,070,270 A * 6/2000 De La Torre ..... 2/171.1
6,189,152 B1 * 2/2001 Lofton ..... 2/171
6,233,745 B1 * 5/2001 Friesen ..... 2/172
6,247,180 B1 * 6/2001 Heinz ..... 2/171
6,247,181 B1 * 6/2001 Hirsch et al. ..... 2/207

(Continued)

*Primary Examiner* — Bobby H Muromoto, Jr.

(57) ABSTRACT

An interior shell component is in a generally hemispherical configuration. The interior shell component has a lower edge forming a generally circular equatorial opening. The interior shell component has a front and rear with sides. The rear has a generally oval-shaped hole. An exterior do-rag component is essentially coincident with the interior shell component. A tail has an upper end above the hole. The tail is formed as an extension of the exterior do-rag component. An adjustment strap is formed in the rear of the interior shell component and the exterior do-rag component.

1 Claim, 2 Drawing Sheets

U.S. PATENT DOCUMENTS

| | | | | | |
|---|---|---|---|---|---|
| D450,173 | S | * | 11/2001 | Allen | D2/866 |
| D474,578 | S | * | 5/2003 | Johnson | D2/879 |
| 6,728,972 | B1 | * | 5/2004 | Whitley | 2/175.1 |
| 6,789,268 | B2 | * | 9/2004 | Yan | 2/209.13 |
| 6,802,083 | B2 | * | 10/2004 | Yan | 2/209.13 |
| 7,096,510 | B2 | * | 8/2006 | Yeadon | 2/202 |
| 7,188,374 | B2 | * | 3/2007 | Carey | 2/209.11 |
| 7,337,475 | B1 | * | 3/2008 | Wood | 2/202 |
| 7,350,241 | B2 | * | 4/2008 | Gendall | 2/206 |
| D572,437 | S | * | 7/2008 | Scott | D2/882 |
| D579,180 | S | * | 10/2008 | Bridges | D2/882 |
| D599,533 | S | * | 9/2009 | Yun | D2/879 |
| 7,681,251 | B2 | * | 3/2010 | Carey | 2/171 |
| D619,337 | S | * | 7/2010 | Martinez | D2/879 |
| 2003/0208831 | A1 | * | 11/2003 | Lazar et al. | 2/69 |
| 2005/0034215 | A1 | * | 2/2005 | Harrison et al. | 2/207 |
| 2006/0005297 | A1 | * | 1/2006 | Blecha | 2/207 |
| 2006/0021111 | A1 | * | 2/2006 | Footman, Jr. | 2/209.13 |
| 2007/0118971 | A1 | * | 5/2007 | Blecha | 2/207 |

* cited by examiner

FIG 1
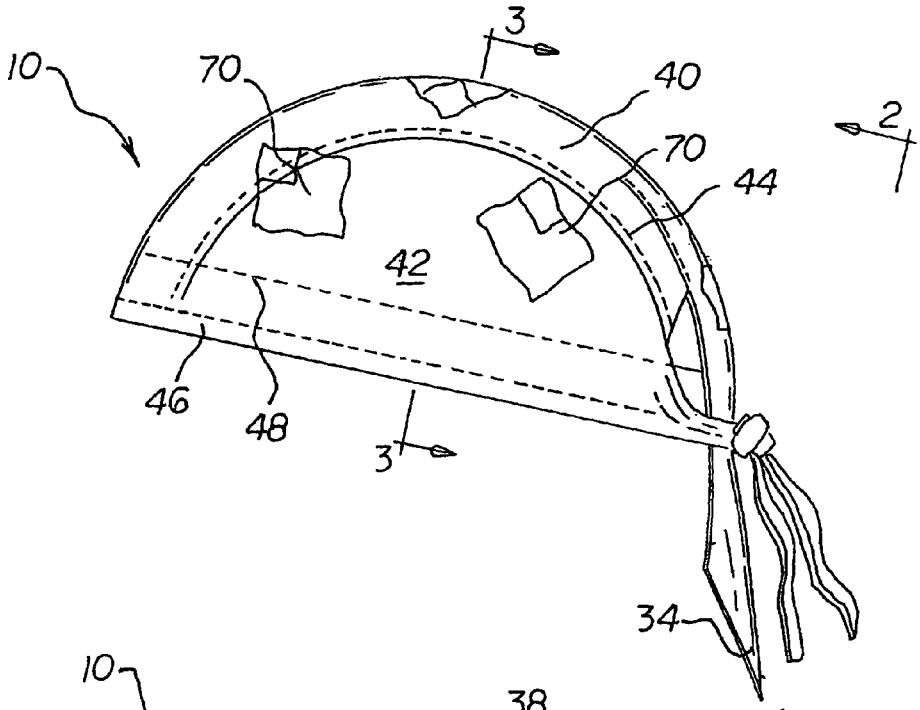
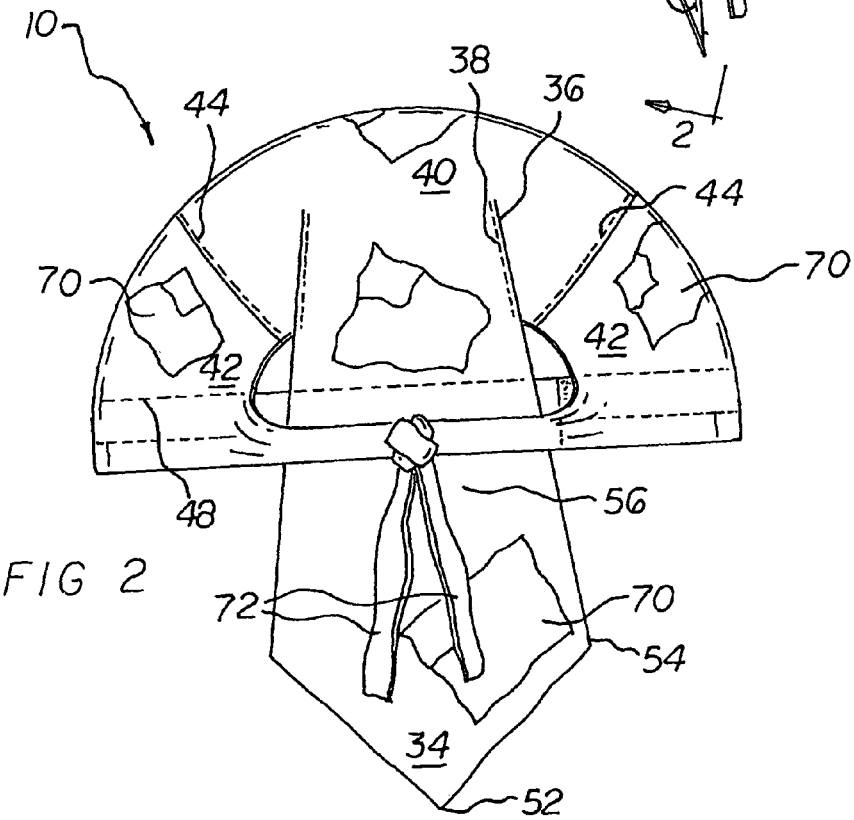
FIG 2

FIG 3
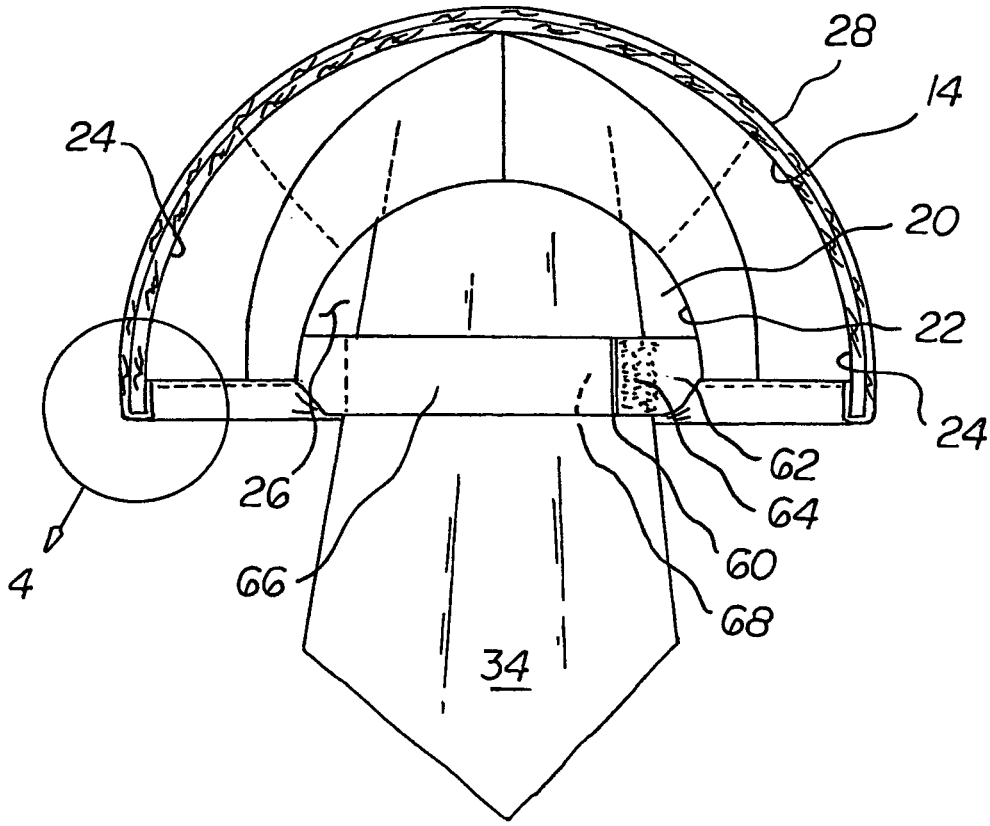
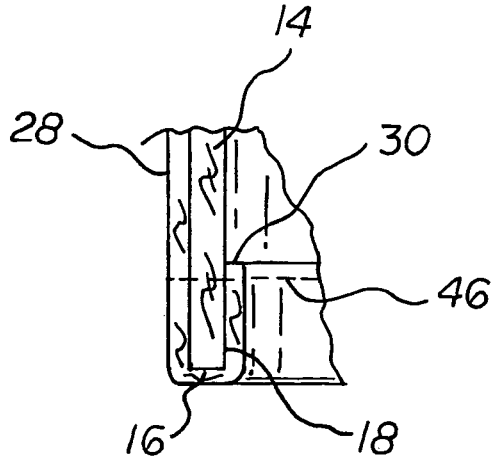
FIG 4

BANDANA HAT SYSTEM

BACKGROUND OF THE INVENTION

Field of the Invention

The present invention relates to a bandana hat system and more particularly pertains to covering a top of a head and rear of a neck of a wearer, the covering being done in a convenient, styling and economical manner.

SUMMARY OF THE INVENTION

In view of the disadvantages inherent in the known types of head covering of known designs and configurations now present in the prior art, the present invention provides an improved bandana hat system. As such, the general purpose of the present invention, which will be described subsequently in greater detail, is to provide a new and improved bandana hat system and method which has all the advantages of the prior art and none of the disadvantages.

To attain this, the present invention essentially comprises a bandana hat system. First provided is an interior shell component. The interior shell component is in a generally hemispherical configuration. The interior shell component has a lower edge. The lower edge forms a generally circular equatorial opening. The interior shell component has a front. The interior shell component has a rear. The interior shell component also has laterally spaced sides. The rear of the interior shell component has a generally oval-shaped hole. The hole has a width of between 20 and 30 percent of the length of the equatorial opening. The hole has a height of between 40 and 60 percent of the width of the hole. The interior shell component is fabricated of a relatively stiff material. The material has limited flexibility.

An exterior do-rag component is provided. The do-rag component is in a generally hemispherical configuration. The interior shell component has an inwardly and upwardly turned lower edge. The lower edge encompasses the lower edge of the interior shell component. In this manner a generally circular equatorial opening is formed coincident with the equatorial opening of the interior shell component. The exterior do-rag component has a front. The exterior do-rag component has a rear. The exterior do-rag component also has laterally spaced sides. The rear of the exterior do-rag component has a generally oval-shaped hole coincident with the hole of the interior shell component. The exterior do-rag component is fabricated of a flexible fabric material.

Further provided is a tail. The tail has an upper end. The upper end is formed as an extension of the exterior do-rag component. Lateral short slits are provided. The lateral short slits are provided between the exterior do-rag and the tail. Short stitching is provided. The short stitching component couples the tail to the exterior do-rag component. The short stitching component further couples the tail to the interior shell component. The do-rag component has a central section. The do-rag component has lateral sections. Long stitching is provided. The long stitching couples the central and lateral sections to the interior shell component. Lower circumferential stitching is provided. The lower circumferential stitching extends through the exterior do-rag component adjacent to its lower edge. The lower circumferential stitching extends through the interior shell component adjacent to its lower edge. The lower circumferential stitching further extends through the exterior do-rag component spaced from its lower edge. Upper circumferential stitching is provided. The upper circumferential stitching extends through the exterior do-rag component above the lower circumferential stitching. The upper circumferential stitching further extends through the interior shell component above the lower circumferential stitching. The tail has a lower end. The lower end of the tail forms an angle of about 90 degrees. The lower end of the tail also forms obtuse side angles. A central region is provided. The central region is provided between the upper and lower ends.

Provided last is an adjustment strap. The adjustment strap is formed in the rear of the interior shell component and the exterior do-rag component. The adjustment strap has a short length. The short length of the adjustment strap has outwardly facing hook and loop fasteners. The adjustment strap has a long length. The long length of the adjustment strap has inwardly facing hook and loop fasteners. The hook and loop fasteners are repositionable. In this manner the size of the equatorial opening may be varied. The exterior do-rag component has an exterior surface. The exterior surface has decorative indicia. The decorative indicia are provided on the central and lateral sections and the tail. The exterior do-rag component has an exterior surface on the adjustment strap. Tied ribbons 72 are provided. The tied ribbons are secured to the exterior surface of the adjustment strap. The central region of the tail is located beneath the adjustment strap and the tied ribbons.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bandana hat system which has all of the advantages of the prior art head covering of known designs and configurations and none of the disadvantages.

It is another object of the present invention to provide a new and improved bandana hat system which may be easily and efficiently manufactured and marketed.

It is further object of the present invention to provide a new and improved bandana hat system which is of durable and reliable constructions.

An even further object of the present invention is to provide a new and improved bandana hat system which is susceptible of a low cost of manufacture with regard to both materials and labor, and which accordingly is then susceptible of low prices of sale to the consuming public, thereby making such bandana hat system economically available to the buying public.

Even still another object of the present invention is to provide a bandana hat system for covering a top of a head and rear of a neck of a wearer, the covering being done in a convenient, styling and economical manner.

Lastly, it is an object of the present invention to provide a new and improved bandana hat system. An interior shell component is in a generally hemispherical configuration. The interior shell component has a lower edge forming a generally circular equatorial opening. The interior shell component has a front and rear with sides. The rear has a generally oval-shaped hole. An exterior do-rag component is essentially coincident with the interior shell component. A tail has an upper end above the hole. The tail is formed as an extension of the exterior do-rag component. An adjustment strap is formed in the rear of the interior shell component and the exterior do-rag component.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a bandana cap system constructed in accordance with the principles of the present invention.

FIG. 2 is a rear elevational view taken at line 2-2 of FIG. 1.

FIG. 3 is a cross sectional view taken along line 3-3 of FIG. 1.

FIG. 4 is an enlarged sectional view taken at Circle 4 of FIG. 3.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved bandana hat system embodying the principles and concepts of the present invention and generally designated by the reference numeral 10 will be described.

The present invention, the bandana hat system 10 is comprised of a plurality of components. Such components in their broadest context include an interior shell component, an exterior do-rag component, a tail and an adjustment strap. Such components are individually configured and correlated with respect to each other so as to attain the desired objective.

First provided is an interior shell component 14. The interior shell component is in a generally hemispherical configuration. The interior shell component has a lower edge 16. The lower edge forms a generally circular equatorial opening 18. The interior shell component has a front 20. The interior shell component has a rear 22. The interior shell component also has laterally spaced sides 24. The rear of the interior shell component has a generally oval-shaped hole 26. The hole has a width of between 20 and 30 percent of the length of the equatorial opening. The hole has a height of between 40 and 60 percent of the width of the hole. The interior shell component is fabricated of a relatively stiff material. The material has limited flexibility.

An exterior do-rag component 28 is provided. The do-rag component is in a generally hemispherical configuration. The interior shell component has an inwardly and upwardly turned lower edge 30. The lower edge encompasses the lower edge of the interior shell component. In this manner a generally circular equatorial opening is formed coincident with the equatorial opening of the interior shell component. The exterior do-rag component has a front. The exterior do-rag component has a rear. The exterior do-rag component also has laterally spaced sides. The rear of the exterior do-rag component has a generally oval-shaped hole coincident with the hole of the interior shell component. The exterior do-rag component is fabricated of a flexible fabric material.

Further provided is a tail 34. The tail has an upper end. The upper end is formed as an extension of the exterior do-rag component. Lateral short slits 36 are provided. The lateral short slits are provided between the exterior do-rag and the tail. Short stitching 38 is provided. The short stitching component couples the tail to the exterior do-rag component. The short stitching component further couples the tail to the interior shell component. The do-rag component has a central section 40. The do-rag component has lateral sections 42. Long stitching 44 is provided. The long stitching couples the central and lateral sections to the interior shell component. Lower circumferential stitching 46 is provided. The lower circumferential stitching extends through the exterior do-rag component adjacent to its lower edge. The lower circumferential stitching extends through the interior shell component adjacent to its lower edge. The lower circumferential stitching further extends through the exterior do-rag component spaced from its lower edge. Upper circumferential stitching 48 is provided. The upper circumferential stitching extends through the exterior do-rag component above the lower circumferential stitching. The upper circumferential stitching further extends through the interior shell component above the lower circumferential stitching. The tail has a lower end 52. The lower end of the tail forms an angle of about 90 degrees. The lower end of the tail also forms obtuse side angles 54. A central region 56 is provided. The central region is provided between the upper and lower ends.

Provided last is an adjustment strap 60. The adjustment strap is formed in the rear of the interior shell component and the exterior do-rag component. The adjustment strap has a short length 62. The short length of the adjustment strap has outwardly facing hook and loop fasteners 64. The adjustment strap has a long length 66. The long length of the adjustment strap has inwardly facing hook and loop fasteners 68. The hook and loop fasteners are repositionable. In this manner the size of the equatorial opening may be varied. The exterior do-rag component has an exterior surface. The exterior surface has decorative indicia 70. The decorative indicia are provided on the central and lateral sections and the tail. The exterior do-rag component has an exterior surface on the adjustment strap. Tied ribbons 72 are provided. The tied ribbons are secured to the exterior surface of the adjustment strap. The central region of the tail is located beneath the adjustment strap and the tied ribbons.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bandana hat system for covering a top of a head and a rear of a neck of a wearer, the covering being done in a convenient, stylish and economical manner, the system comprising, in combination:

an interior shell component in a generally hemispherical configuration and positionable over a wearer's head, the interior shell component having a lower edge forming a generally circular equatorial opening, the interior shell component having a front and a rear with laterally spaced sides, the rear of the interior shell component having a generally oval-shaped hole, the hole having a width of between 20 and 30 percent of the length of the equatorial opening, the hole having a height of between 40 and 60 percent of the width of the hole, the interior shell component being fabricated of a relatively stiff material with limited flexibility;

an exterior do-rag component in a generally hemispherical configuration positionable over the interior shell component, the interior shell component having an inwardly and upwardly turned lower edge encompassing the lower edge of the interior shell component and forming a generally circular equatorial opening coincident with the equatorial opening of the interior shell component, the exterior do-rag component having a front and a rear with laterally spaced sides, the rear of the exterior do-rag component having a generally oval-shaped hole coincident with the hole of the interior shell component, the exterior do-rag component being fabricated of a flexible fabric material;

a tail having an upper end formed as an extension of the exterior do-rag component, lateral short slits between the exterior do-rag and the tail with short stitching coupling the tail to the exterior do-rag component and to the interior shell component, the do-rag component having a central section and lateral sections with long stitching coupling the central and lateral sections to the interior shell component, lower circumferential stitching extending through the exterior do-rag component adjacent to its lower edge and through the interior shell component adjacent to its lower edge and through the exterior do-rag component spaced from its lower edge, upper circumferential stitching extending through the exterior do-rag component above the lower circumferential stitching and through the interior shell component above the lower circumferential stitching, the tail having a lower end forming an angle of about 90 degrees and obtuse side angles with a central region between the upper and lower ends; and an adjustment strap formed in the rear of the interior shell component and the exterior do-rag component, the adjustment strap having a short length with outwardly facing hook and loop fasteners, the adjustment strap having a long length with inwardly facing hook and loop fasteners, the hook and loop fasteners being repositionable to vary the size of the equatorial opening, the exterior do-rag component having an exterior surface with decorative indicia on the central and lateral sections and the tail, the exterior do-rag component having an exterior surface on the adjustment strap with tied ribbons secured to the exterior surface of the adjustment strap, the central region of the tail being located beneath the adjustment strap and the tied ribbons.

* * * * *